US008339234B2

(12) United States Patent
Grisenti et al.

(10) Patent No.: US 8,339,234 B2
(45) Date of Patent: Dec. 25, 2012

(54) INDUCTANCE COIL FOR ELECTRIC POWER GRIDS WITH REDUCED SOUND EMISSION

(75) Inventors: Alexander Grisenti, Gunskirchen (AT); Josef Eder, Rohrbach (AT); Johann Muelleder, Vienna (AT)

(73) Assignee: Coil Holding GmbH, Eferding (AT)

( * ) Notice: Subject to any disclaimer, the term of this patent is extended or adjusted under 35 U.S.C. 154(b) by 44 days.

(21) Appl. No.: 12/737,311

(22) PCT Filed: Jun. 30, 2009

(86) PCT No.: PCT/AT2009/000259

§ 371 (c)(1),
(2), (4) Date: Jan. 26, 2011

(87) PCT Pub. No.: WO2010/000005

PCT Pub. Date: Jan. 7, 2010

(65) Prior Publication Data

US 2011/0115601 A1 May 19, 2011

(30) Foreign Application Priority Data

Jun. 30, 2008 (AT) ..... A 1035/2008

(51) Int. Cl.
*H01F 27/28* (2006.01)
*H01F 27/00* (2006.01)

(52) U.S. Cl. ..... 336/222; 336/100; 336/170

(58) Field of Classification Search ..... 336/100, 336/170, 171, 146, 147, 222; 324/313, 314, 324/316, 318

See application file for complete search history.

(56) References Cited

U.S. PATENT DOCUMENTS 1,706,193 A * 3/1929 Stephens ..... 336/170
2,422,037 A * 6/1947 Paluev ..... 336/60
2,686,905 A * 8/1954 Schneider ..... 336/84 R
3,102,246 A * 8/1963 Honey et al. ..... 336/100

(Continued)

FOREIGN PATENT DOCUMENTS

AT 501 074 6/2006

(Continued)

OTHER PUBLICATIONS

International Search Report.

(Continued)

*Primary Examiner* — Mohamad Musleh
*Assistant Examiner* — Joselito Baisa
(74) *Attorney, Agent, or Firm* — Collard & Roe, P.C.

(57) ABSTRACT

The invention relates to an inductance coil, in particular an inductance coil without an iron core for use in electric power grids, comprising at least two cylindrical winding layers (1), which are disposed concentrically with respect to a coil central axis (7) and are connected electrically in parallel. The inductance coil comprises at least one means for reducing or minimizing sound emissions produced during the operation of the inductance coil. At least the outermost winding layer (1) is designed in this case as a current-conducting, acoustic shield winding (18) opposite the winding layer (1) adjacent in the direction of the coil central axis (7), wherein the shield winding (18) is dimensioned electrically such that it is designed for the transmission of a current intensity, which is only a fraction of the current intensity, to be transmitted by the adjacent winding layer (1). Furthermore, the invention relates to a bracket-like holding element arranged on at least one end face of the inductance coil for reducing sound emissions.

23 Claims, 3 Drawing Sheets

U.S. PATENT DOCUMENTS

| | | | | | |
|---|---|---|---|---|---|
| 3,175,173 | A | * | 3/1965 | Welch | 336/84 R |
| 3,309,639 | A | | 3/1967 | Goolsby, Jr. | |
| 3,362,001 | A | * | 1/1968 | Wishman et al. | 336/60 |
| 3,538,473 | A | * | 11/1970 | Leibinger | 336/187 |
| 3,902,147 | A | * | 8/1975 | Trench | 336/65 |
| 3,991,394 | A | | 11/1976 | Barnwell et al. | |
| 4,477,792 | A | | 10/1984 | Putman et al. | |
| 4,488,134 | A | | 12/1984 | Pfeiffer | |
| 5,150,046 | A | | 9/1992 | Lim | |
| 5,481,191 | A | * | 1/1996 | Rzedzian | 324/318 |
| 5,572,131 | A | * | 11/1996 | Rzedzian | 324/318 |
| 7,141,974 | B2 | * | 11/2006 | Edelstein et al. | 324/318 |
| 7,256,675 | B2 | * | 8/2007 | Chen | 336/180 |
| 7,375,526 | B2 | * | 5/2008 | Edelstein et al. | 324/318 |
| 8,203,341 | B2 | * | 6/2012 | Teklemariam et al. | 324/318 |

FOREIGN PATENT DOCUMENTS

| | | |
|---|---|---|
| DE | 322 440 | 7/1920 |
| DE | 577 650 | 6/1933 |
| DE | 22 46 235 | 3/1974 |
| EP | 0 075 796 | 4/1983 |
| EP | 0 692 018 | 10/1983 |
| GB | 1 426 217 | 2/1976 |
| JP | 09-017657 | 1/1997 |
| JP | 2000-040626 | 2/2000 |
| WO | WO 02/063605 | 8/2002 |
| WO | WO 2006/024057 | 3/2006 |

OTHER PUBLICATIONS

International Preliminary Report on Patentabilty of PCT/AT2009/000259 dated Mar. 1, 2011.

* cited by examiner

INDUCTANCE COIL FOR ELECTRIC POWER GRIDS WITH REDUCED SOUND EMISSION

CROSS REFERENCE TO RELATED APPLICATIONS

This application is the National Stage of PCT/AT2009/000259 filed on Jun. 30, 2009, which claims priority under 35 U.S.C. §119 of Austrian Application No. A 1035/2008 filed on Jun. 30, 2008, the disclosure of which is incorporated by reference. The international application under PCT article 21(2) was not published in English.

The invention relates to an inductance coil, in particular an inductance coil without an iron core for use in electric power grids, with at least two cylindrical winding layers, which are arranged concentrically with respect to a coil central axis and are connected electrically in parallel, and with at least one means for reducing or minimizing sound emissions produced during the operation of the inductance coil.

In coils, particularly in dry-insulated inductance coils without an iron core with two or more winding layers, which are arranged concentrically inside one another allowing gaps and are connected electrically in parallel, it is known to wind the winding layers from rectangular shaped conductors or conductor bundles, wherein the winding layers have different numbers of windings mostly decreasing from the inside to the outside. The basic structure of winding layers that are arranged concentrically inside one another and arranged electrically in parallel is known from the prior art, for example from European Patent EP 0 092 018 B.

FIGS. 1 and 2 show the basic structural configuration of such winding layers 1 and coil windings built therefrom. The winding layers 1, which are arranged concentrically inside one another about a common coil central axis 7 and which are largely produced as rectangular conductors or conductor bundles 6, are held together by holding elements 2 at the coil ends, for example so-called winding stars made of metal or plastic. As a rule, the holding elements 2 arranged in the two distal end sections of the coil are held together by a tensioning construction, e.g. by several tensioning elements 3 made of impregnated glass fibres, which are attached along the winding. Mainly when the holding elements 2 conduct electricity, insulation elements 4 are usually attached between the holding elements 2 and the coil or winding ends. The winding layers 1 arranged concentrically inside one another are spaced apart in radial direction preferably by additional insulating elements 5, for example electrically insulating gap strips, in order to provide vertical gaps for the natural air cooling of the entire inductance coil winding. The extent to which conductors or conductor bundles 6 consisting of several insulated individual conductors are used depends on the anticipated eddy current losses which need to kept within economic limits.

The number of windings of the winding layers 1 or the number of electrical coils to be produced is determined so that both the desired degree of inductivity is achieved and also the desired distribution of current and operating temperature is achieved via the parallel connected winding layers 1—see FIG. 1. With this requirement various different numbers of windings decreasing mainly from the inside to the outside are provided for the electrically parallel connected winding layers 1.

An axial voltage gradient that is as even as possible in all winding layers 1, thereby avoiding the essential voltage difference between the opposite windings of adjacent winding layers 1 is ensured by having uniform heights or uniform axial lengths of the individual winding layers 1, i.e. by maintaining as far as possible uniform axial winding layer heights H. This is achieved by adjusting the height GH1, GH2, GH3 of the conductor or conductor bundle 6 as measured in the axial direction of the winding layers 1 to the different numbers of windings of the electrically parallel connected winding layers 1. The height GH1, GH2, GH3 of the conductor or conductor bundle 6 in the individual winding layers 1 as measured in axial direction of the winding layers 1 is also known as the pitch, which defines the dimension of the conductor or conductor bundle 6 in the direction of the winding or coil axis. Owing to the number of windings, which mainly decreases from the inner winding layers 1 to the outer winding layers 1, the conductors or conductor bundles 6 have larger dimensions in axial direction in the outer winding layers 1. In particular, the conductors or conductor bundles 6 of the outer winding layers 1 in parallel direction to the coil longitudinal or coil central axis 7 have greater heights GH2, GH3, than the heights GH1 of the conductors or conductor bundles 6 of the inner winding layer 1 of the coil.

The adjustment of the axial height GH1, GH2 or GH3 of the conductor or the conductor bundle 6 to the respectively required conductor or conductor bundle 6 with an almost or largely rectangular cross sectional shape is performed by pressing a circular conductor or a rope-like conductor material. The required dimensions of the conductors or the conductor bundles 6, in particular the previously mentioned pitches GH1, GH2, GH3, are calculated according to the number of windings for the concentrically arranged winding layers 1 defined by the electrical or thermal design of the inductance coil. The increase caused by the electrical external insulation of the conductor or conductor bundle 6 to be applied is taken into consideration when determining the required dimensions.

According to the known prior art the conductors with a circular cross section in the original state or the rope-like conductor bundle strands are shaped or pressed into a largely rectangular cross sectional shape with the precalculated dimensions. The external insulation is then applied onto said conductors or conductor bundles, usually by means of high-temperature-resistance insulation foils and/or impregnable fabric bands.

An advantageous production process for an inductance coil described above is described in detail in AT 501 074 A1, which belongs to the Applicant.

Air-core inductors, i.e. inductance coils with an air core and without an iron core, are largely used in electrical systems for the transmission and distribution of energy, and in power supply systems of industrial plants. Owing to the increasing density and interworking of electric power supply grids electrical medium and high-voltage systems are increasingly being set up in the immediate vicinity of residential areas, which in itself increases the demand for particularly low-noise inductance coils. This is also increasingly reflected in the legal stipulations relating to the permissible sound emissions of electrical operating means. A property of the inductance coils known from the prior art is also that the latter, depending on the type of power and current spectrum, in particular in the case of loading with high alternating currents or a combined loading of high direct current and alternating current, emit noise which people consider disruptive, particularly in residential areas adjacent to inductance coil installations.

According to the prior art the problem of sound emissions is mainly dealt with in that in the configuration of the inductance coil it is ensured that the frequencies of specific, distinct vibrational forms do not coincide with the frequency spectrum of essentially stimulating forces. In this way disadvantageous increases in noise caused by mechanical resonance vibrations are avoided. If the total sound level is still too high further measures are taken to reduce the sound emission of the inductance coil. This can for example be a strategically advantageous positioning of the inductance coil within the high voltage system. A conventional measure is also to encapsulate the inductance coil to dampen the sound as far as possible, which can have a disadvantageous effect on the required air cooling. It is also known, as indicated schematically in FIG. 3, to assign a sound protection housing 8 to the inductance coil or to arrange the inductance coils in a separate building 9. Also configuring the sound protection walls 10 next to the inductance coils is a conventional solution.

These conventional methods can involve high additional costs and also technical problems with electric feed lines and outgoing lines 11, 12 to the high voltage connections of the inductance coil. For example, openings 13, 14 in a sound protection housing 8 for guiding through the electrical connections must have the required and at least necessary voltage gaps 15, 16, which can lead to a considerable decrease in the efficiency of the sound shielding effect.

On the basis of this prior art the underlying objective of the invention is to create inductance coils with sound emissions which are reduced or as low as possible, wherein the measures for reducing or minimising the sound emissions should be as economic and effective as possible.

This objective is achieved by the measures according to the invention. It is advantageous in this case that an inductance coil designed in this way produces much less sound compared to conventional inductance coils, in particular produces much less current flow-induced noise in the form of a monotone, acoustic humming signal. According to the invention at least the outermost, current-conducting winding layer of the inductance coil acts as a sound barrier for the sound waves produced inside the winding core. This means that the noises or vibrations produced in the inner winding layers of the inductance coil are not emitted or are only emitted to a much reduced extent into the environment of the inductance coil. The outermost shield winding itself in this case has only a low or negligible natural vibration and therefore generates no sound itself or much lower or weaker sounds. A considerable advantage of this design is that the current-conducting acoustic shield winding has the same or almost same voltage potential as the at least one immediately adjacent winding layer of the inductance coil, whereby the risk of voltage breakdowns is eliminated. Since the acoustic shield winding itself represents an electrical part component, in particular an individual coil of the inductance coil, it is not necessary to adhere to minimum voltage gaps. Such minimum voltage gaps can be considerable distances in the high voltage range, in particular up to one meter and more. Mainly in medium and high-voltage systems, in which for example the voltage is 60 kV, it is not necessary when using the inductance coil according to the invention to maintain a distance of about 60 cm from the sound-reducing or sound-blocking means, i.e. from the acoustic shield winding. In particular, it is permissible or possible and expedient to position the acoustic shield winding relatively close to the concentrically arranged winding layers of the inductance coil, as it is not necessary in an advantageous manner to take into account the minimum voltage gaps for the respective high voltage. An inductance coil according to the invention is therefore much quieter compared to conventional inductance coils with the same or almost the same electrical power. Furthermore, such a relatively quiet inductance coil installation is relatively compact in its configuration. In particular, the space required for a low noise inductance coil according to the invention is relatively small. An inductance coil according to the invention reaches relatively low sound levels even without external encapsulation or housing, so that often it is possible to omit additional passive sound damping measures, such as e.g. complex or expensive housings.

In an embodiment it is an advantage that the shield winding carries much less current than the inner winding layers and is thereby itself barely excited into oscillation. In this way even without structurally relatively complex, external housings or encapsulations a comparatively quiet inductance coil can be obtained.

The extent of reduction of the sound emissions can be improved further by another embodiment. In particular, in this way two radially spaced apart sound barriers are created for the sound which is emitted by the inner or innermost winding layers of the inductance coil in radial direction. In particular, in this way also the sound emitted radially in the direction of the coil center is at least partly damped or caught by the inner acoustic shield winding.

By means of another embodiment a vibrational insulation or uncoupling of the inner winding layers which vibrate during operation from the outer shield winding or from the outer shield windings is achieved. Also in this way the sound emission of such an inductance coil is noticeably reduced.

By way of the measures according to another embodiment it is avoided or at least partly achieved that the winding layers that vibrate or oscillate during operation transfer their vibrational energy to the outer winding layers designed as acoustic shield windings. In this way the acoustic shield windings are barely excited or excited with much less vibration. This results in a much lower sound emission of the inductance coil.

By way of the measures according to another embodiment voltage differences are avoided and an even voltage gradient is achieved as far as possible. It is advantageous in this case that in this way no minimum voltage gaps have to maintained between the sound shielding means, i.e. the at least one acoustic shield winding and the section of the inductance coil conducting high voltage. In particular, the acoustic shield winding is a part component of the electric functional components of the inductance coil. In this way sound-reduced inductance coils are created, which can also be configured and operated to be relatively compact and inexpensive.

In another embodiment it is an advantage that the current flowing in the acoustic shield winding can be adjusted in an effective and unproblematic manner such that the acoustic shield winding is barely vibrated so that the overall construction of the inductance coil has a relatively low sound emission.

The extent of the sound damping or limitation of sound distribution via the acoustic shield winding can also be improved by another embodiment. In particular, in this way the excitation of mechanical vibrations of the shield winding is considerably reduced owing to the mechanical vibrations of the inner winding layers of the inductance coil.

An independent solution according to the invention is described below. It is advantageous in this case that sound waves which are produced inside the winding and are mainly diverted or guided via the free spaces or gaps between the winding layers to the end faces of the inductance coil, are not emitted or only emitted to a reduced extent into the environment of the inductance coil. With such an extension section on at least one end face of the inductance coil as a result a much reduced level of sound emission can be achieved. In particular, antiphase sound waves can be at least partly eliminated in the region of the zone formed by said extension section. This measure for reducing sound emissions can thus be implemented in a particularly effective manner and relatively inexpensively.

By way of another embodiment potential differences are avoided and as far as possible an even axial voltage gradient is achieved in all of the winding layers. In this way this measure for reducing sound emissions can be produced particularly simply in an operationally reliable, relatively inexpensive and structurally particularly simple manner.

By way of the measures according to another embodiment an unwanted expansion of the sound waves emerging from at least one end face of the inductance coil is reduced or suppressed. The sound emissions of the inductance coil are reduced in this way by a considerably amount.

By way of the measures according to another embodiment as far as possible a uniform axial voltage gradient is achieved in all winding layers and thus considerable voltage differences are avoided between the opposite windings of adjacent winding layers.

The sound emissions can be reduced further by the measures according to another embodiment. In particular in this way sound expansions are minimized and suppressed in radial direction to the coil central axis and in radial direction away from the coil central axis.

By means of the precautions according to another embodiment a particularly effective convergence, elimination and damping of the sound emission is achieved. The radial sound emission of the inner winding layer and inner winding layers is largely guided in vertical direction, i.e. in parallel direction to the coil central axis. Thus the directional characteristic of the sound emission is changed, whereby at least the partial elimination of the sound waves at the end or at the ends of the inductance coil is supported. Since each vibrating winding layer emits as far as possible the same amount of sound from its inside and outside an efficient elimination can take place, since the soundwaves of said sound emissions are at least partly in antiphase. In particular, a local convergence of the spreading sound waves is achieved and reciprocal elimination is provided. In this mixing and elimination zone in this case mainly the lower frequency components are eliminated.

By way of the measures according to another embodiment also the sound distribution of the higher frequency components can be stemmed more effectively. In addition, in the mixing and elimination zone a greater degree of sound elimination can be achieved. An inductance coil equipped in this way thus has a much reduced level of sound emissions.

By way of the embodiment in addition to the optimal, inexpensive and efficient suppression of the sound distribution or the sound emissions also a good and sufficient degree of cooling is ensured for the inner winding layers of the inductance coil.

Independently thereof, the objective of the invention is also achieved by means of an inductance coil according to another aspect.

It is advantageous in this case that sound emissions, which come from the support or holding element for the mechanical stabilisation or electrical connection of the winding layers, are considerably reduced. In particular, vibrational excitation is reduced in a holding or connecting element according to the invention, as lateral buckling of the arms of the bracket-like connecting element is eliminated or minimised. Said buckling or vibration of the arms of a conventional holding element is mainly caused by the pump-like movements of the winding layers during the operation of the inductance coil. The holding elements, which are a considerable source of sound, which in practice are also known as winding stars are thus replaced by the indicated, comparatively less sound emitting connecting bracket or substituted by the connecting brackets, which generate less sound.

By way of another embodiment diametrically opposite or straight connections are avoided over the entire cross section of the inductance coil. The angled connecting brackets can on the one hand provide the desired electrical connections between the winding layers and in addition contribute as far as possible to low or reduced sound emission, since the respective arms of the connecting brackets in their middle sections do not buckle or buckle only to a small degree or vibrate a relatively small amount.

An advantageous bracket shape in terms of structure and installation is described below.

By way of another embodiment the requirements of a connection or electric pickup of various fractional amounts of a whole winding can be easily taken into account. At the same time the required mechanical stability of the inductance coil is achieved and the maintenance of the cylindrical shape or circular shape of the inductance coil is ensured.

In another embodiment it is an advantage that the buckling of the arms of the connecting brackets is prevented or much reduced owing to the electromagnetic pumping or vibrating movements of the inductance coil. In particular, in this way a mechanical vibration of the connecting bracket or its arms is reduced considerably or avoided completely.

Vibrations of the arms of the connecting brackets caused by tensile stress or compressive stress, which can differ in terms of production and can occur for example because of changes in temperature during the operation of the inductance coil, by means of the design according to another embodiment have no influence or only a marginal influence on the vibrational behavior of said connecting brackets. In particular, in this way a particularly low oscillation and low vibration connecting bracket is produced.

Lastly, the design according to another embodiment is extremely low vibration and low-noise. Furthermore, the thermal expansion of such a construction caused during operation can be balanced out easily. Temperature-influenced vibrations and noise sources or sound developments, which were previously caused by the end face holding or connecting elements, are largely avoided in this way.

For a better understanding of the invention the latter is explained in more detail with reference to the following Figures.

In a much simplified schematic representation:

Figure 6A:
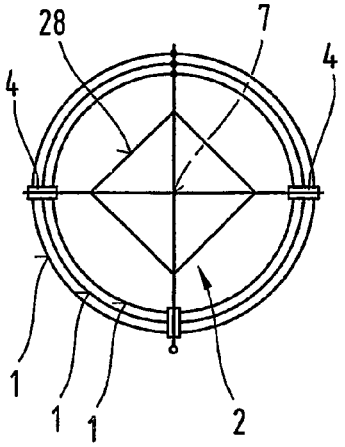
Figure 6B:
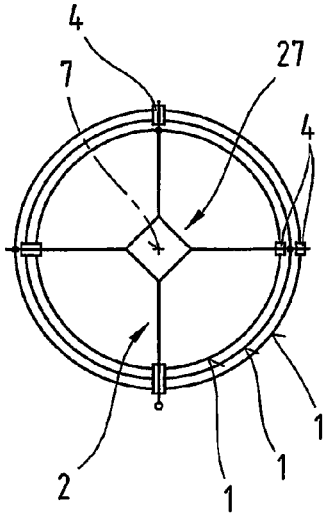
Figure 6C:
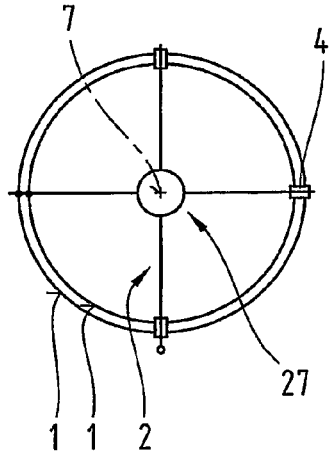
Figure 7A:
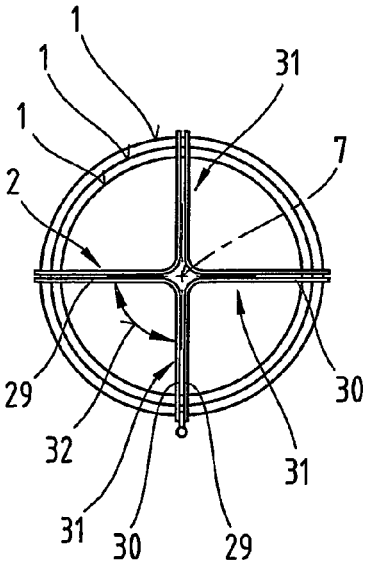
Figure 7B:
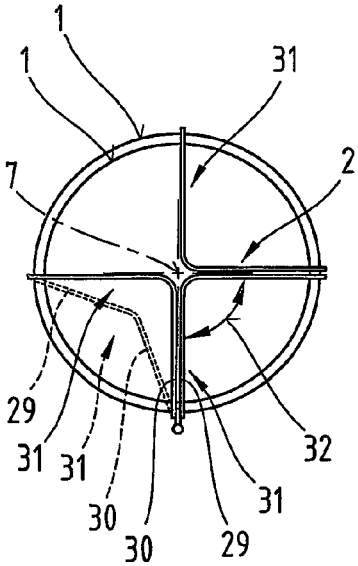
Figure 7C:
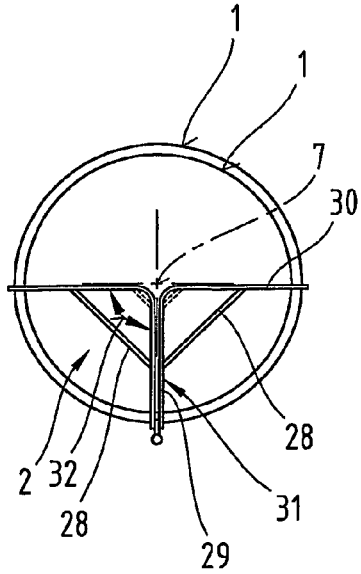

FIGS. 6*a* to 6*c* show end face holding elements on inductance coils according to the prior art;

FIGS. 7*a* to 7*c* show inductance coils with end face holding elements according to the invention in different arrangements and embodiments.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

The basic structure of inductance coils and measures for reducing sound emissions, as known from the prior art, were described above with reference to FIGS. 1 to 3.

Figure 4:
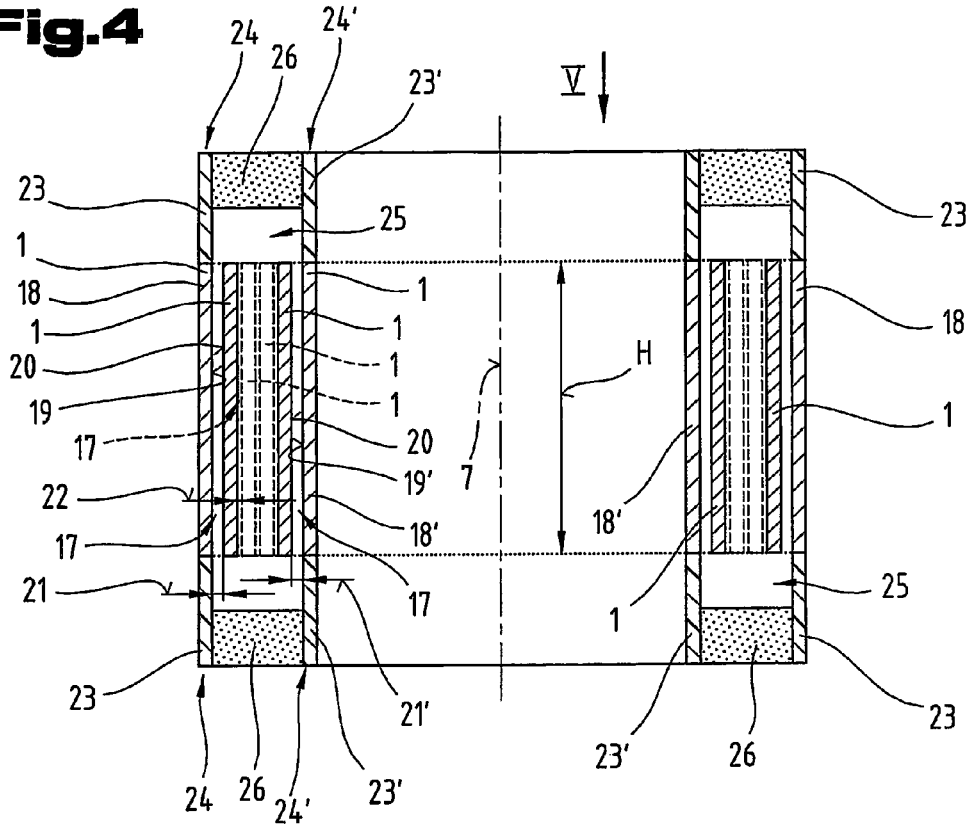
FIG. 4 shows an inductance coil in longitudinal cross section with measures according to the invention for reducing its sound emissions.

FIG. 4 shows a schematic longitudinal cross section of an inductance coil with several measures for reducing sound emissions, which are created during active operation, i.e. from current flow through the inductance coil. The measures described in the following with reference to FIGS. 4 and 5 for reducing sound emissions can be used in combination and also independently. The individual measures for sound reduction or sound suppression can represent in themselves independent solutions according to the invention.

Said inductance coil comprises several winding layers 1, which are arranged concentrically with respect to their coil central axis 7 and connected electrically in parallel. Such an inductance coil is also known as a multi-layered inductance coil, wherein in practice up to 20 winding layers 1 and individual coils can be provided. At least two such cylindrical winding layers 1 form an inductance coil according to the invention, wherein the diameter of the winding layers 1 arranged concentrically inside one another is such that between the casing surfaces of the individual winding layers 1, i.e. between the individual coil windings, defined free spaces or gaps 17 are provided for air flushing the winding layers 1, in particular as air flow channels. Usually the winding layers 1 of the inductance coil are distributed around the circular circumference of the winding layers or spaced apart insulation elements 5—FIG. 2—are mutually supported in radial direction. Said insulation elements 5—FIG. 2—are also often referred to as gap strips.

The current distribution through the parallel connected winding layers 1 has been selected until now so that a largely uniform temperature distribution is achieved over the individual winding layers 1 of the multi-layered inductance coil. The comparatively improved cooling properties of the innermost and in particular the outermost winding layer 1 of the inductance coil have been taken into account accordingly. In conventional inductance coils therefore the outermost winding layer 1 and/or the innermost winding layer 1 guided a higher current than the remaining winding layers 1, i.e. the adjacent and intermediate winding layers 1 or individual coils. The desired current distribution between the parallel connected winding layers 1 is in this case—as already known—controlled essentially by the number of windings of the individual winding layers 1.

Conversely, by way of a measure according to the invention, at least the outermost winding layer 1 and possibly the innermost winding layer 1 should be designed as an acoustic shield winding 18 or 18', which compared to the adjacent winding layer in the direction of the coil central axis 7 or compared to the closest winding layer 1 conducts much less current. At least the outermost winding layer 1 of the inductance coil in this way forms a current-conducting acoustic shield winding 18. Said shield winding 18 is in this case dimensioned with respect to its electrical properties such that it is provided or designed for the transmission of a current intensity, which is only a fraction of the current intensity, which is to be transmitted by the immediately adjacent or closest winding layer 1. According to an advantageous development, mainly when at least three concentrically arranged, electrically parallel winding layers 1 or individual coils are provided, also the innermost winding layer 1 of the inductance coil is designed as an inner acoustic shield winding 18'. For this purpose, said inner acoustic shield winding 18' transmits only a fraction of the current intensity which has to be transmitted by the adjacent winding layer 1 which is comparatively much larger in diameter. According to an advantageous embodiment the inductance coil is designed such that the outermost winding layer 1 forms an external acoustic shield winding 18 and the innermost winding layer 1 of the multi-layered inductance coil composed of several individual coils forms an inner acoustic shield winding 18'.

The shield windings 18, 18' are thus formed by structurally largely unchanged electrical winding layers 1, which are also current-conducting, or which are also used for the transmission of current parallel to the inner or central winding layers 1 of the inductance coil. At least the outermost and possibly the innermost winding layer 1 of the inductance coil forms an acoustic shield winding 18, 18' charged with current and voltage on the inductance coil. The acoustic shield winding 18, 18' is thus a sound barrier for sound emissions, which are generated or emitted by the inner winding layers 1 or the inner part or individual coils of the inductance coil. In particular, the sound, which is necessarily produced by the inner winding layers 1 of the inductance coil, is only emitted or radiated in an advantageous manner in a much reduced form into the environment of the inductance coil. In particular, in this case an inner casing surface 19 of the shield winding 18 and possibly an outer casing surface 19' of an inner shield winding 18'—with regard to the coil central axis 7—functions as a sound barrier, wherein the acoustic, current-conducting shield winding 18, 18' itself, owing to the relatively low currents or power transmission, only causes a relatively low amount of sound or represents a marginal and relatively unimportant sound source.

It is expedient in this case to size the acoustic shield winding 18 such that it is provided or designed for the transmission of a current intensity, which is between 0.1% to a maximum of 50% of the current intensity, which is to be transmitted from the winding layer 1 adjacent in the direction of the coil central axis 7.

An advantageous dimensioning or current distribution inside the inductance coil is also provided when the current intensity to be transmitted by the acoustic shield winding 18 and/or 18' is between 0.1% to 5% of the current intensity, which is to be transmitted from the inductance coil overall, i.e. by all of the winding layers 1, in particular by the shield winding 18, 18' and the additional winding layers 1.

It is essential that the outer shield winding 18 and the optional additional inner shield winding 18' compared to the adjacent winding layers 1 carry relatively small currents and thus provide an effective acoustic shield winding 18 and/or 18'. At the shield winding 18 and/or 18' the voltage potential is the same or almost the same as at the immediately adjacent electrically parallel connected winding layer 1.

To achieve the desired current distribution conditions it is expedient that the acoustic shield winding 18, 18' has a higher electrical impedance Z, i.e. a higher alternating current resistance, than the winding layer 1 adjacent in the direction of the coil central axis 7.

A further way of minimising or reducing sound emissions consists of mechanically uncoupling the cylindrical casing surface 19, 19' of the acoustic shield winding 18, 18' from the nearest cylindrical casing surface 20 of the adjacent winding layer 1 and insulating in vibrational terms the casing surfaces 19, 19' of the acoustic shield winding 18, 18' from the cylindrical casing surface 20 of the adjacent winding layer 1. For this mainly in the end face sections between the shield winding 18, 18' and the adjacent winding layer 1 vibration or oscillation-damping connections are formed, for example with the use of elastomer elements. In particular, between the inner and the outer casing surface 19, 19' of the acoustic shield windings 18, 18' and the nearest casing surface 20 of the adjacent winding layer 1 a through air gap or gap 17 is formed with preferably an uninterrupted hollow-cylindrical shape. In particular, in the gap 17 between the shield winding 18, 18' and the adjacent winding layer 1 no radially acting support elements are provided, in particular no strip-like insulation elements 5—as known from the prior art according to FIG. 2. This means that the casing surfaces 19, 19' cannot be supported relative to the casing surfaces 20 in radial direction of the inductance coil. Thus the transmission of mechanical vibrations or oscillations via the casing surfaces 19, 19', 20 to the outside of the inductance coil is minimised and much reduced, whereby the sound emissions from such an inductance coil can be lowered. The vibrations or oscillations occurring in the inner winding layers 1, which are caused by the winding layers 1 flowed through by high alternating currents, are in this way transmitted barely reduced or much reduced to the outermost or innermost winding layer 1 of the inductance coil.

An efficient way of reducing sound emissions is also that a radial distance 21, 21' between the casing surface 19, 19' of the acoustic shield winding 18, 18' and the casing surface 20 of an adjacent winding layer 1 is greater than a radial distance 22 between two adjacent winding layers 1 arranged concentrically to the acoustic shield winding 18, 18'. Advantageous conditions or effects are achieved if the distance 21, 21' is up to ten times greater, preferably about two to four times greater than the distance 22 between the inner winding layers 1. The distance 22 is as a rule about 2 to 4 cm, preferably about 3 cm. This means that the insulation elements 5—according to FIG. 2—between the inner winding layers 1 of the inductance coil usually have a support width or strip width of about 3 cm.

The individual winding layers 1 and the at least one shield winding 18, 18' are designed respectively as hollow cylinders. The term casing surface or cylindrical casing surface 19, 19', 20 defines the inner and/or outer casing surfaces of said hollow or hollow cylindrical bodies.

In a further, particularly independent way of reducing sound emissions at least one acoustic shield winding 18, 18', i.e. at least the outermost and optionally the innermost winding layer 1 of the inductance coil on at least one end face comprises a hollow cylindrical or polygonal extension section 23, 23' running in axial direction. Said hollow body shaped extension section 23, 23', which is hollow cylindrical in cross section or polygonal in cross section, connects with at least one end face of the outermost and/or innermost winding layer 1. This means that said extension section 23, 23' forms a structural extension of the current-conducting acoustic shield winding 18, 18' in axial direction of the inductance coil. In particular, the extension section 23, 23' projects over the end faces of the winding layers 1 in axial direction. The extension sections 23, 23' are thus an extension of the electrical section of the inductance coil. Preferably, the hollow cylindrical extension section 23, 23' is made of electrically insulating material, for example glass-fibre reinforced plastic or resin-impregnated bands which are wound into a hollow cylindrical shape. The extension section 23 formed preferably at least on the outermost shield winding 18 is thus preferably not current-conducting. According to an advantageous embodiment also on the inner shield winding 18', in particular on the innermost winding layer 1, a hollow cylindrical, electrically insulating and thus non-current-conducting extension section 23' is formed. This means that the hollow cylindrical extension section 23 and/or 23' forms a non-electricity conducting end ring 24 and/or 24' on the inductance coil, which connects to at least one end face of the electrically conducting section of the inductance coil, in particular on at least one end face of the shield winding 18, 18'. Preferably, at least on the upper end face of the shield winding 18, 18', in particular on the upper end of the outermost and/or innermost winding layer 1 an end ring 24, 24' is formed.

An axial length or the winding layer height H of the current conducting section of the acoustic shield winding 18, 18' corresponds at least approximately to an axial length or winding layer height H of the electrically parallel connected winding layers 1. According to a particularly effective embodiment at least on the upper end faces of the outer and inner acoustic shield winding 18, 18' respectively an outer and inner hollow-cylindrical or polygonal in plan view extension section 23, 23' is formed. Said respectively designed extension sections 23, 23' extend the outer and the inner shield winding 18, 18' in axial direction relative to the end faces of the winding layers 1 arranged in between.

By means of such an extension section 23, which is formed at least on the outer shield winding 18, an acoustic mixing and elimination zone 25 is produced for sound waves which escape in axial direction of the inductance coil from the gap 17 or gaps 17. In the region of the extension section 23 or 23' thus an acoustic near-field zone is formed, in which the sound occurring at the end faces of the winding layers 1 is reduced or dampened. In particular, sound waves which are produced in the gaps 17, i.e. in the air gaps between the winding layers 1, are diverted in axial direction and guided to the end faces of the winding layers 1. In said end face areas, in which at least one extension section 23, 23' is formed, the mixing and elimination zone 25 is produced for the sound waves. In particular, due to antiphase sound waves in the region of the mixing and elimination zone 25 at least several sound waves are deleted or compensated, whereby the sound emission of the inductance coil is reduced. The compensation or elimination effect of the mixing and elimination zone 25 can be increased in that both an outer extension section 23 and an inner extension section 23' is formed as in this way a spatially delimited and defined mixing and elimination zone 25 is formed. Such a mixing and elimination zone 25 is also created if an extension section 23 is formed only on the outer shield winding 18 or winding layer 1.

According to an advantageous development adjacent to the mixing and/or elimination zone, in particular above and/or below the mixing and elimination zone 25, passive and/or reactive sound absorbing elements 26, for example blocks or board elements are formed, made of foamed plastic or fibres, such as e.g. fleece or rock wool. The sound absorbing elements 26 can also be formed by knitted bundles, fibre mats and/or sound absorbing boards with a relatively high mass, such as e.g. tar boards. The sound-absorbing elements 26 are preferably arranged spaced apart in axial direction to the face ends of the winding layers 1. The mixing and elimination zone 25 for axially escaping, antiphase sound waves is formed in the free space between the sound absorbing elements 26 and the end faces of the winding layers 1.

Figure 5:
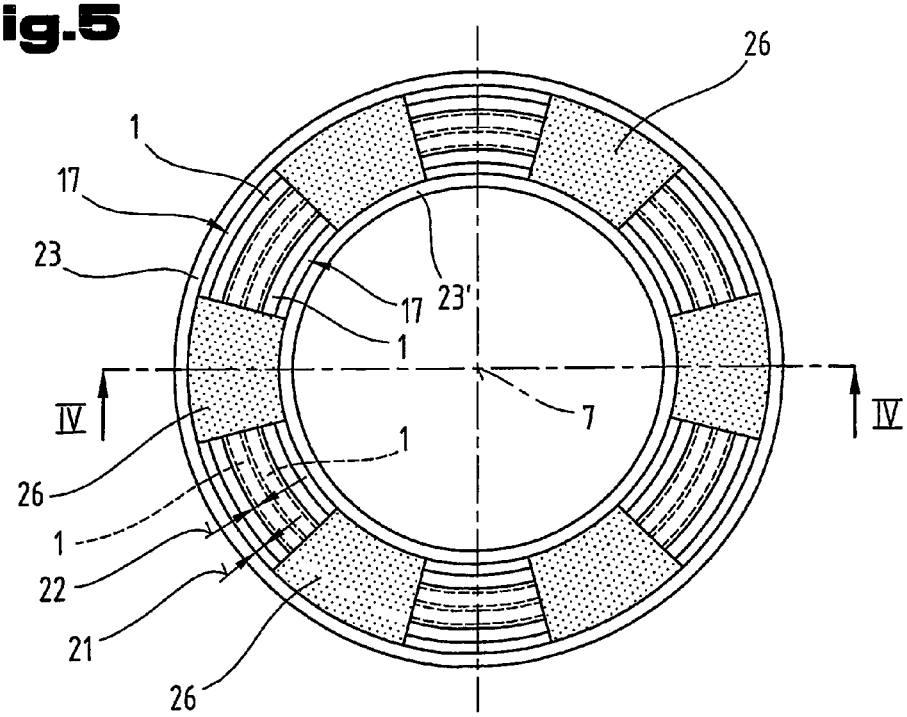
FIG. 5 shows the inductance coil according to FIG. 4 in plan view.

It is advantageous to arrange a plurality of openings in the sound absorbing elements 26 and/or in the case of forming several sound absorbing elements 26 to arrange the latter spaced apart from one another, as shown by way of example in FIG. 5. In this way, between the winding layers 1 an air flow is ensured in parallel direction to the coil central axis 7. The individual sound absorbing elements 26 are distributed in this case over the circular circumference of the inductance coil and arranged spaced apart from one another. In particular, said sound absorbing elements 26 allow the outlet of air heated by the winding layers 1 within the gaps 17 from the inside of the inductance coil.

In the described inductance coil it is advantageous that the outwardly directed sound radiation of the outer winding layer 1 is reduced in that the latter is designed as a mechanically uncoupled or vibrationally insulated shield winding 18 and compared to the winding layer 1 adjacent in the direction of the coil central axis guides a relatively low current, whereby it is hardly vibrated itself. By means of the current flow in the shield winding 18 and 18' there is a controlled reduction in voltage, whereby the latter has almost the same voltage potential as the adjacent winding layer 1, which eliminates the risk of voltage breakdown. Since the ends of the shield winding 18 or 18' have the same electrical potential as the holding elements 2 or the electrical connections of the inductance coil, the electrical connection of the inductance coil is straightforward despite the acoustic shield winding 18 and 18'.

Figure 1:
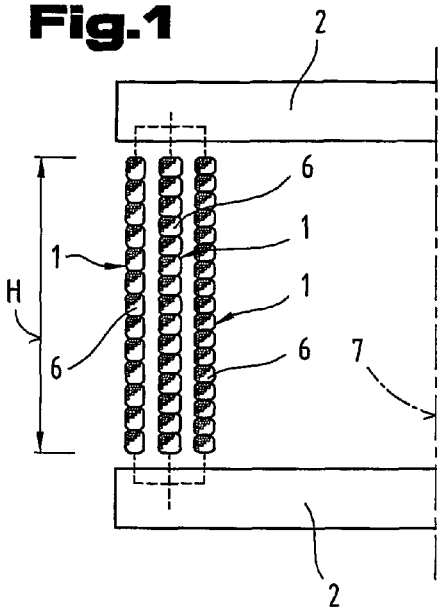
FIG. 1 shows a section of an inductance coil consisting of three coaxially arranged, cylindrical winding layers according to the prior art.
Figure 2:
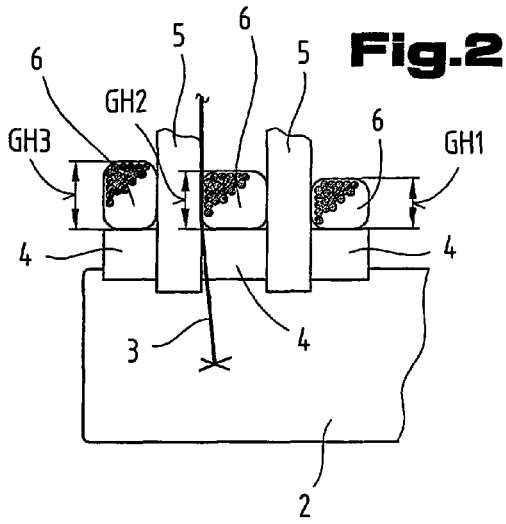
FIG. 2 shows a detailed section of FIG. 1 on an enlarged scale.
Figure 3:
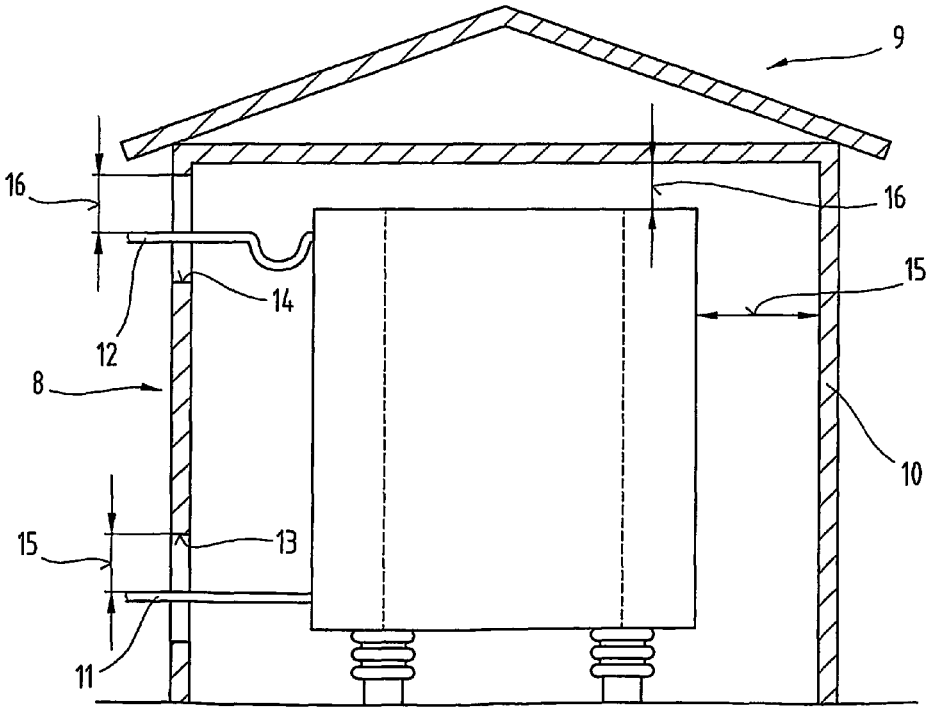
FIG. 3 shows conventional measures for reducing sound emissions produced during the operation of an inductance coil.

FIGS. 6*a* to 6*c* show examples known from the prior art of four-armed holding elements 2, as described with reference to FIGS. 1 and 2. Said holding elements 2 can in practice also have only two or three or more than four star-shaped arms. In particular, holding arms 2 are known from the prior art with up to twelve star-shaped arms. Said holding elements 2, which are often denoted as winding stars, have the task of giving the inductance coil sufficient mechanical stability or robustness. The holding elements 2 are also often used for distributing all of the current to be guided via the inductance coil to the parallel connected winding layers 1. For this the holding element 2 is made from an electricity conducting material, in particular metal, such as e.g. aluminium or stainless steel. The holding elements 2 are mostly arranged on the upper and lower side of the inductance coil, as shown in FIG. 1. A holding element 2 arranged on the upper side and on the lower side of the inductance coil thus mostly also forms the respective electrical connection for the supply and removal of the coil current, as illustrated schematically by ring symbols in FIGS. 6*a* to 6*c*.

According to the prior art the holding elements 2 are designed to be star-shaped constructions, which are often formed from an aluminium profile. The individual arms of said star-shaped holding elements 2 can also be used to achieve the desired or required current distribution between the winding layers. In particular, if for the fine adjustment of the current distribution in the parallel connected winding layers 1 the graduation of the number of windings as integer values is not sufficient, by means of the arms of the holding element 2 also fractions of a complete winding can be picked up or made available. This means that specific or selected arms of a holding element 2 are used to activate fractions of a winding into the individual, parallel connected winding layers. For example, in the embodiment according to FIG. 6*b* 25%, 50% or 75% of the last winding can be used in the various winding layers 1. Of course also 100% of a winding can be used. Furthermore, the electrical connection of the individual winding layers 1 in the design according to FIG. 6*a* is made respectively in a uniform position in relation to the circular circumference of the inductance coil. The same applies to the exemplary embodiment according to FIG. 6*c*. The electrical connection between the individual winding layers 1 and the holding elements 2 is illustrated by symbolic nodal points.

In those sections of the holding element 2, in which no electrical connection is provided to the winding layers 1, insulation elements 4 can be formed, which can also have a mutual support or stabilisation function, as described with reference to FIGS. 1, 2. In particular, an electricity conducting holding arm 2 is preferably supported with the interconnection of at least one electrical insulation element 4 relative to the face ends of the winding layers 1, as shown mainly in FIG. 2 schematically.

The arms of conventional holding elements 2 are either connected securely to one another directly or via a central hub 27, in particular are welded or screwed together. In this way, in the known holding elements 2 or winding stars there is a mechanically rigid connection between the arms or star arms.

The Applicant has recognised that these conventional holding elements 2 on the upper side of the coil and on the lower side of the coil can represent a distracting and problematic source of noise. In particular, in the case of dry-insulated air-core inductors, which can reach dimensions of up to several meters, said sources of sound act independently of one another and produce a disadvantageous, locally differing spectrum of noise. In particular, the Applicant has recognised that the known constructions of holding elements 2 due to the pump-like movement of the inductance coil flowed through by alternating current are subjected to alternating tensile stress and compressive stress. Inter alia, owing to the rigid connection of the arms in the star middle point or centre of the holding element 2 said arms buckle laterally alternately, whereby they can vibrate and can represent a significant or disruptive source of noise. The extent of the noise produced by this effect is difficult to estimate and difficult to control, because in this way mechanical tensions from the production process and heat expansions during the operation of the inductance coil represent a cause variable. In particular, the Applicant has recognised that the arms of the holding elements 2 can represent a kind of membrane, which generates unwanted noise.

If the holding element 2 is used in addition for current distribution, then different mechanical forces occur in the different arms, which on the one hand are caused by the different current strengths and on the other hand are caused by the varying intensity of the vibrational excitation. The rigid connection of the individual arms in the centre of the star-shaped holding element 2 in this case causes the transmission of forces or vibrations to other arms, whereby the latter are also stimulated to vibrate and similarly produce noises.

Attempts have been made previously to reduce the mechanical vibrations of the arms of the holding elements 2 with supports or reinforcements 28 between the arms, as shown in FIG. 6*a*. This produces the problem however that in this way arms, through which little or no current flows, and which therefore would produce few vibrations, are similarly activated to vibrate.

On the basis of this prior art the Applicant has found a relatively economical and effective solution for reducing or minimising the sound emissions from the holding elements 2, as illustrated by way of example with reference to FIGS. 7*a* to 7*c*. The embodiments according to FIGS. 7*a* to 7*c* can thus represent in themselves an independent solution according to the invention. According to this embodiment the holding element 2 is designed to consist of several parts. In particular, on the axial end faces of the inductance coil at least two, structurally independent holding elements 2 are formed such that they are not connected together in the central area of the inductance coil, i.e. in the area around the coil central axis 7. This means that a rigid connection between the at least approximately radial or radial arms is avoided in the centre point of the inductance coil that is circular in plan view. In this way the vibrational buckling of the arms is prevented or reduced as a result of the pump-like movement or vibration of the inductance coil. In particular, the individual winding layers 1 of the inductance coil at suitably high current flows can constitute a kind of pulsating pipe, which transmits mechanical vibrations to the holding elements 2.

According to the invention two arms 29, 30 respectively form a mechanical and/or electric connecting bracket 31 for at least one winding layer 1. It is essential that the two arms 29, 30 of such a connecting bracket 31 are arranged at an angle to one another, i.e. in that an angle 32 is formed between the two arms 29, 30 of the connecting bracket 31. Said angle 32 between the two arms 29, 30 of the connecting bracket 31 performing electrical and/or mechanical functions is less than 180°, preferably 90°. This angle 32 depends essentially on which stabilisation effect is to be achieved by the connecting bracket 31 and/or which part angle or part sections of a full winding of the winding layers 1 are required. Mainly if it is necessary to have relatively small part windings the angle can also be less than 90°.

An advantageous measure for reducing or minimising the sound emissions of the inductance coil is thus that on at least one axial face end of the inductance coil at least one angled connecting bracket 31 is formed, wherein the arms 29, 30 of said connecting bracket 31 in a plan view of the inductance coil are arranged at a predefined angle 32 to one another, which is less than 180°. This means that the connecting bracket 31 performing a mechanical support function and/or an electrical conducting function do not extend diametrically or continuously over the circular or hollow cylindrical inductance coil in plan view. Rather the at least one electrical and/or mechanical connecting bracket 31 is angled such that a diametrical, straight extension over the cross sectional surface of the inductance coil is avoided. This means that the connecting bracket 31 provided at least once, preferably many times defines or delimits, in plan view of the face end of the inductance coil, the geometric shape of a circle segment.

Mainly if the connecting bracket 31 has to form an electrical connection between the concentrically arranged winding layers 1 connected electrically in parallel, several connecting brackets 31 are provided distributed within the circular circumference of the inductance coil. Selected, distal ends of the individual connecting brackets 31 are thus provided for electrical connection with selected winding layers 1. It is advantageous in this case if the individual connecting brackets 31 are not connected together mechanically in the area around the coil central axis 7, in particular run independently of one another and do not form a central or common hub 27. According to an advantageous embodiment the individual connecting brackets 31 are only connected together mechanically and electrically at the distal end sections, in particular in the region of the winding layers 1.

Mainly in the embodiment of several angled or bracket-like connecting brackets 31 it is advantageous if the closest arms 29, 30 of two adjacent connecting brackets 31 are arranged spaced apart from one another, so that immediately adjacent arms 29, 30 are uncoupled from one another mechanically, in particular are insulated from one another in terms of vibration.

Between the immediately adjacent arms 29, 30 of two adjacent connecting brackets 31 also a defined angle can be provided, as indicated in FIG. 7*b* by dashed lines. Said angled arms 29, 30 are closest to one another in the vicinity of the winding layers 1. Preferably, on the face ends or close to the face ends the arms 29, 30 contact one another or the arms 29, 30 merge into one another in the region of the winding layers 1.

Instead of round transitional sections between the two arms 29, 30 of a connecting bracket 31 it is also possible to provide oblique transitions between the two arms 29, 30, as indicated by dashed lines in FIG. 7*c* by way of example.

Connecting brackets 31 that are not needed for current distribution can be omitted if they are also not required, as shown in FIG. 7*b*, 7*c*.

By means of the described embodiment the forces produced by the current flow and/or by the mechanical vibrations of the winding layers 1 in a connecting bracket 31 are not transmitted or only transmitted to a much reduced extent to the other connecting bracket 31. This is mainly because the individual connecting brackets 31 of the holding element 2 according to the invention are only connected together mechanically and/or electrically in the region of the winding layers 1 or the whole winding of the inductance coil. Vibrations between the distal ends of the connecting bracket 31 and the winding layers 1 are prevented or virtually non-existent because of the rigid connection of the distal ends of the connecting bracket 31 or connecting brackets 31 to the winding layers 1.

The individual connecting brackets 31 are preferably insulated electrically from one another in the area between their distal ends, so that no loop current can be formed as a result of electromagnetic induction. The connecting brackets 31 are preferably only fixed onto the winding or face end sections, i.e. connected to the winding layers 1. In this way between the individual connecting brackets 31 no transmission of force can occur whereby this construction is relatively low-vibration and low-noise. Furthermore, heat expansions of said construction of the holding element 2 consisting of at least one angled connecting bracket 31 can be equalised without difficulty.

Thus no essential or critical forces can be produced or transmitted between the individual connecting brackets 31. If necessary reinforcements 28 can be provided, which extend only within a connecting bracket 31 and do not have a mechanical influence on other adjacent connecting brackets 31, as can best be seen from the exemplary representation according to FIG. 7*c*.

The exemplary embodiments show possible embodiment variants of a low-noise inductance coil, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the inductance coil the latter and its components have not been represented true to scale in part and/or have been enlarged and/or reduced in size.

The underlying objective of the independent solutions according to the invention can be taken from the description.

Mainly, the individual embodiments shown in FIGS. 4, 5 and 7 can form the subject matter of independent solutions according to the invention. The objectives and solutions according to the invention relating thereto can be taken from the detailed descriptions of these figures.

LIST OF REFERENCE NUMERALS

1 Winding layer
2 Holding element
3 Tensile element
4 Insulation element
5 Insulation element
6 Conductor bundle
7 Coil central axis
8 Sound protection housing
9 Building
10 Sound protection wall
11 Feed line
12 Outgoing line
13 Opening
14 Opening
15 Voltage gap
16 Voltage gap
17 Gap
18, 18' Shield winding
19, 19' Casing surface
20 Casing surface
21, 21' Distance
22 Distance
23, 23' Extension section
24, 24' End ring
25 Mixing and elimination zone
26 Sound absorbing element
27 Hub
28 Reinforcement
29 Arm
30 Arm
31 Connecting bracket
32 Angle
H Winding layer height
GH1 Height of the conductor/conductor bundle
GH2 Height of the conductor/conductor bundle
GH3 Height of the conductor/conductor bundle

The invention claimed is:

1. Inductance coil, in particular an inductance coil without an iron core for use in electric power grids, comprising at least two cylindrical winding layers (1), which are disposed concentrically with respect to a coil central axis (7) and are connected electrically in parallel, and at least one means for reducing or minimizing sound emissions produced during the operation of the inductance coil, wherein at least the outermost winding layer (1) is designed as a current-conducting, acoustic shield winding (18) opposite the adjacent winding layer (1) in the direction of the coil central axis (7), wherein said acoustic shield winding (18) is dimensioned electrically such that it is designed for the transmission of a current intensity, which is between 0.1% to a maximum of 50% of the current intensity, which has to be transmitted by the adjacent winding layer (1) in the direction of the coil central axis (7).

2. Inductance coil according to claim 1, wherein the current intensity to be transmitted by the acoustic shield winding (18) is between 0.1% to 5% of the current intensity to be transmitted by the inductance coil overall.

3. Inductance coil according to claim 1, wherein at least three concentrically arranged, electrically parallel connected winding layers (1) are provided, wherein the outermost winding layer (1) forms an external acoustic shield winding (18) and the innermost winding layer (1) forms an inner acoustic shield winding (18').

4. Inductance coil according to claim 3, wherein at least on the upper end faces of the outer and inner acoustic shield winding (18, 18') respectively an outer and inner hollow cylindrical extension section (23, 23') is formed, which extends the outer and inner acoustic shield winding (18, 18') in axial direction relative to the end faces of the winding layers (1) arranged in between.

5. Inductance coil according to claim 1, wherein a cylindrical casing surface (19, 19') of the acoustic shield winding (18, 18') is mechanically uncoupled or is vibrationally insulated from a cylindrical casing surface (20) of the adjacent winding layer (1).

6. Inductance coil according to claim 1, wherein between a casing surface (19, 19') of the acoustic shield winding (18, 18') and a casing surface (20) of the adjacent winding layer (1) a continuous gap (17) is formed with a hollow-cylindrical shape, so that in this gap (17) no radially acting support elements are arranged between the acoustic shield winding (18, 18') and the adjacent winding layer (1).

7. Inductance coil according to claim 1, wherein the current-conducting acoustic shield winding (18, 18') has the same or at least almost the same voltage potential as at the immediately adjacent, electrically parallel connected winding layer (1).

8. Inductance coil according to claim 1, wherein the acoustic shield winding (18, 18') has a greater electrical impedance than the winding layer (1) which is adjacent in the direction of the coil central axis (7).

9. Inductance coil according to claim 1, wherein a radial distance (21) between a casing surface (19, 19') of the acoustic shield winding (18, 18') and a casing surface (20) of an adjacent winding layer (1) is greater in size than a radial distance (22) between two immediately adjacent winding layers (1) arranged concentrically to the acoustic shield winding (18, 18').

10. Inductance coil according to claim 1, wherein the outermost winding layer (1), in particular the current-conducting, acoustic shield winding (18), on at least one end face comprises a hollow cylindrical extension section (23) running in axial direction.

11. Inductance coil according to claim 10, wherein the hollow cylindrical extension section (23) is formed from electrically insulating material and is not current-conducting.

12. Inductance coil according to claim 10, wherein the hollow cylindrical extension section (23) forms an electrically non-conducting end ring (24), which connects with at least one end face of the electrically conducting section of the shield winding (18).

13. Inductance coil according to claim 10, wherein an axial length or winding layer height (H) of the current-conducting section of the acoustic shield winding (18) corresponds at least approximately to an axial length or winding layer height (H) of the winding layers (1).

14. Inductance coil according to claim 10, wherein next to the hollow-cylindrical extension section (23), in particular between the outer and inner hollow-cylindrical extension section (23, 23') an acoustic mixing and elimination zone (25) is formed for sound waves which occur at said axial end face of the winding layers (1).

15. Inductance coil according to claim 14, wherein in the axial direction of the coil central axis (7) after the mixing and elimination zone (25) passive and/or reactive sound absorbing elements (26) are provided, for example blocks or plate elements made of foamed plastic or fibres, such as e.g. fleeces or rock wool.

16. Inductance coil according to claim 15, wherein in the sound absorbing elements (26) openings are formed or wherein several sound absorbing elements (26) are arranged spaced apart from one another so that between the winding layers (1) an air-flow is ensured in parallel direction to the coil central axis (7).

17. Inductance coil, in particular an inductance coil without an iron core for use in electric power grids, with at least two cylindrical winding layers (1) which are arranged concentrically with respect to a coil central axis (7) and are connected electrically in parallel, comprising at least one holding element (2) for mechanical stabilization and if necessary electrical connection of the winding layers (1), and with at least one means for reducing or minimizing sound emissions produced during the operation of the inductance coil, wherein the holding element (2) is formed by an angled connecting bracket (31) arranged on at least one axial end face of the inductance coil, and wherein said connecting bracket (31) is formed by two angled arms (29, 30) which are at least almost radial to the coil central axis (7).

18. Inductance coil according to claim 17, wherein the connecting bracket (31) is designed to conduct electricity and is provided for the electrical parallel connection of winding layers (1), wherein the angle (32) formed between the two arms (29, 30) of the connecting bracket (31) is less than 180°, preferably 90°.

19. Inductance coil according to claim 17, wherein the connecting bracket (31) in plan view of the end face of the inductance coil defines the geometrical shape of a circle segment.

20. Inductance coil according to claim 17, wherein several connecting brackets (31) are arranged distributed within the circular circumference of the inductance coil and wherein selected, distal ends of the individual connecting brackets (31) are provided for electrical connection with selected winding layers (1).

21. Inductance coil according to claim 17, wherein several connecting brackets (31) are provided and the individual connecting brackets (31) in the vicinity around the coil central axis (7) or in the region of the center of the winding layers (1) that are circular in plan view are independent of one another and are not connected together mechanically, in particular do not form a central hub (27).

22. Inductance coil according to claim 17, wherein several connecting brackets (31) are formed and the individual connecting brackets (31) are joined together mechanically and electrically only at the distal end sections, in particular in the region of the winding layers. (1).

23. Inductance coil according to claim 17, wherein several connecting brackets (31) are provided and the nearest adjacent arms (29, 30) of two adjacent connecting brackets (31) are at least almost parallel to one another and are spaced apart from one another, so that immediately adjacent arms (29, 30) are uncoupled from one another mechanically.

* * * * *